US006230493B1

(12) United States Patent
Häuser et al.

(10) Patent No.: US 6,230,493 B1
(45) Date of Patent: May 15, 2001

(54) STEAM POWER STATION

(75) Inventors: Ulrich Häuser, Lampertheim; Pengcheng Zhang, Hemsbach, both of (DE)

(73) Assignee: ABB Patent GmbH, Mannheim (DE)

( * ) Notice: Subject to any disclaimer, the term of this patent is extended or adjusted under 35 U.S.C. 154(b) by 0 days.

(21) Appl. No.: 09/531,206

(22) Filed: Mar. 20, 2000

(30) Foreign Application Priority Data

Mar. 19, 1999 (DE) ..... 199 12 415
Feb. 9, 2000 (DE) ..... 100 05 727

(51) Int. Cl.[7] ..... F01K 13/00
(52) U.S. Cl. ..... 60/645; 60/670
(58) Field of Search ..... 60/645, 670

(56) References Cited

U.S. PATENT DOCUMENTS 3,939,356 * 2/1976 Loane ..... 290/52
3,953,971 * 5/1976 Parker ..... 60/641
4,038,821 * 8/1977 Black ..... 60/398
4,464,080 * 8/1984 Gorlov ..... 405/76

FOREIGN PATENT DOCUMENTS 196 40 100
A1 4/1998 (DE) .

* cited by examiner

*Primary Examiner*—Hoang Nguyen
(74) *Attorney, Agent, or Firm*—Herbert L. Lerner; Laurence A. Greenberg; Werner H. Stemer

(57) ABSTRACT

A steam power station includes a power house, an annex, a turbogroup disposed in the power house, and a condenser having a condenser neck connected to the turbogroup, and main cooling-water lines including at least one inlet and at least one outlet, the condenser disposed lateral to the turbogroup and the condenser, the at least one inlet, and the at least one outlet disposed in the annex. A conventional power house places a condenser, a condenser neck, and main cooling-water lines inside a power house. Accordingly, such a power house must be larger with respect to both height and width. To reduce the overall volume of the power house, the condenser of the invention is laterally disposed next to the turbogroup within an annex. The turbogroup has a turbine center line, the condenser has a center line located below the turbine center line, and the condenser neck has a gradient towards the condenser. The gradient can be predetermined.

3 Claims, 1 Drawing Sheet

STEAM POWER STATION

BACKGROUND OF THE INVENTION

FIELD OF THE INVENTION

The invention lies in the field of power generation. The invention relates to a steam power station.

German Published, Non-Prosecuted Patent Application DE 196 42 100 A1, discloses a steam power station. In the publication, the condenser is disposed laterally next to the turbine on the turbine foundation and, therefore, is obviously located inside the power house even though it is not shown in the publication. Locating the condenser inside the power house requires that the power house be widened by several meters, which leads to a corresponding increase in the span and installation height of the power house crane. To reduce cost, the widening is made as small as possible, thus restricting the optimization of the construction of the condenser neck, such optimization helps increase the efficiency of the power plant. When turbine and condenser are disposed on the same foundation, a return flow of the condensate to low-pressure turbines is not ensured and a greater delivery head of the main cooling-water pumps is to be expected. Furthermore, the condensate receiver of the condenser can only be used directly by a special construction for draining the components in the vacuum state. According to the above mentioned publication, the center line of the condenser is disposed above the turbine center line. As such, an unfavorable flow behavior and a higher pressure loss are produced by the exhaust-steam deflection. An additional draining device for the low-pressure turbine casing is necessary, which entails an increase in the overall height of the top part of the low-pressure turbine casing and, thus, a corresponding increase in height of the power house.

SUMMARY OF THE INVENTION

It is accordingly an object of the invention to provide a steam power station that overcomes the hereinaforementioned disadvantages of the heretofore-known devices of this general type and that reduces the height and width of the power house and also causes no restriction in the configuration of the condenser neck.

With the foregoing and other objects in view, there is provided, in accordance with the invention, a steam power station including a power house, an annex, a turbogroup disposed in the power house, and a condenser having a condenser neck connected to the turbogroup, and main cooling-water lines including at least one inlet and at least one outlet, the condenser disposed lateral to the turbogroup, and the condenser, the inlet and the outlet disposed in the annex.

The configuration permits a reduction in the overall volume of the power house. The length of the condenser neck, due to the fact that it is disposed in a freely extendable annex, can be freely selected regardless of the height and width of the power house. Thus, an optimum condenser diffuser configuration for improving the efficiency of the steam power station is ensured. A uniform inflow zone is ensured over the entire outflow cross section of the condenser neck. The configuration ensures optimum determination of the diffuser angle $\alpha$, which influences the flow behavior in the condenser neck. In an optimally configured condenser neck, the steam flow is decelerated to a lower velocity with minimum losses with simultaneous pressure recovery.

In accordance with another feature of the invention, the turbogroup has a turbine center line, the condenser has a center line located below the turbine center line, and the condenser neck has a gradient towards the condenser.

In accordance with a concomitant feature of the invention, the gradient is predetermined.

In order to avoid condensate runback from the condenser to the turbine and unfavorable flow behavior due to exhaust-steam deflection, the condenser neck has a predeterminable gradient in the direction of the condenser, with the center line of the condenser being located below the turbine center line.

Other features that are considered as characteristic for the invention are set forth in the appended claims.

Although the invention is illustrated and described herein as embodied in a steam power station, it is nevertheless not intended to be limited to the details shown because various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
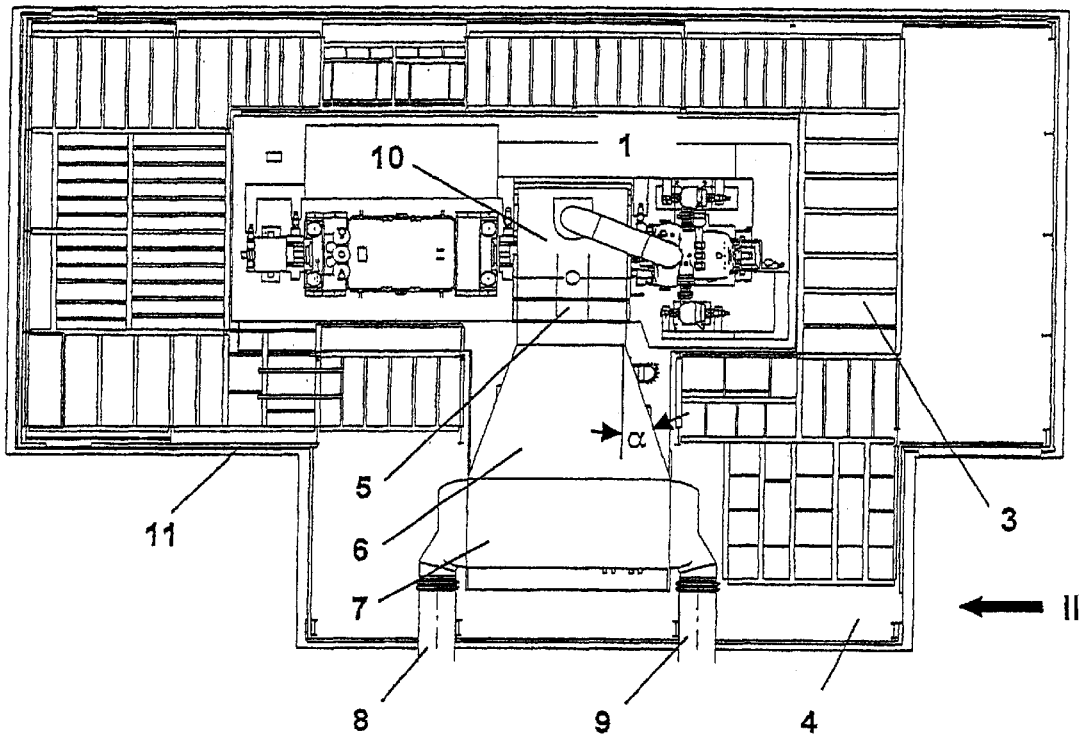
FIG. 1 is a view from above of steam power station components disposed in a power house and an annex according to the invention.

In all the figures of the drawing, sub-features and integral parts that correspond to one another bear the same reference symbol in each case.

Figure 2:
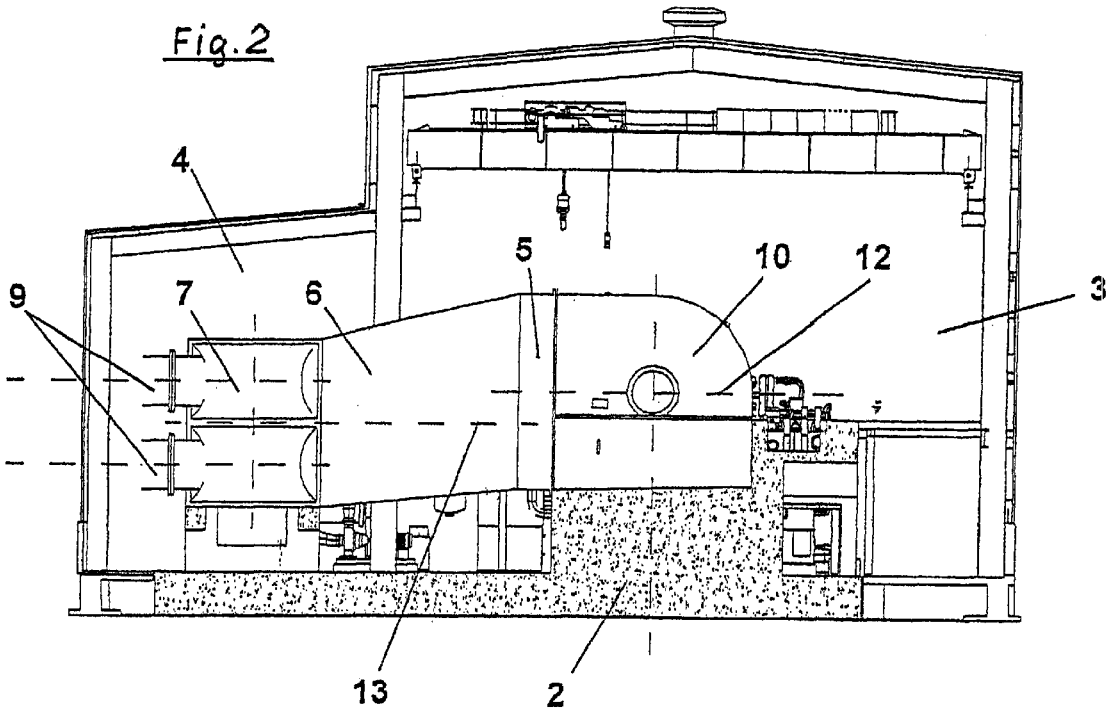
FIG. 2 is a side view in a direction indicated by arrow II in FIG. 1, with a cross section in a region of a condenser.

Referring now to the figures of the drawings in detail and first, particularly to FIGS. 1 and 2, there is shown a turbogroup 1 of a steam power station. The turbogroup 1 is supported on a foundation slab 2 isolated from the power house 3. An annex 4 adjoins the power house 3. For the power house and the annex, only the supporting structure is shown so that the configuration of the components located therein can be viewed. Depending on the climatic conditions, the annex may be configured as a fully enclosed housing, may be provided only with a roof, or may be an open-air type of construction.

As can be seen from FIG. 1, the turbogroup 1 is oriented in the longitudinal extent of the power house 3 and secured relative to the power house. An exhaust-steam flow leaving the low-pressure part of the turbine 10 through an outlet casing 5 passes through a condenser neck 6 acting as a diffuser to a condenser 7 configured in the annex 4. An inlet 8 and outlet 9 for the main cooling water is connected to non-illustrated pipelines. The condenser neck bridges the distance between the condenser 7 and the outlet casing 5 and, in the process, passes through the wall 11 between the annex 4 and the power house 3. As can be seen from FIG. 2, the condenser neck 6 has a gradient that acts in the direction of the condenser 7 and is dimensioned to be so large that condensate runback to the turbine is reliably avoided. The center line 13 of the condenser 7 is located below the turbine center line 12 in order to ensure, for example, a return flow of the condensate to the low-pressure turbines. The lateral configuration of the condenser 7 allows for a shorter construction height for the turbogroup and, thus, a correspondingly shorter power house. Furthermore, optimum determination of a diffuser angle $\alpha$ (FIG. 1), which influences the flow behavior in the condenser neck, is ensured. To improve the efficiency of the steam power station, the length of the condenser neck may be changed without problem for an optimum condenser diffuser configuration.

We claim:

1. A steam power station, comprising:

a power house;

an annex;

a turbogroup disposed in said power house; and a condenser having a condenser neck connected to said turbogroup, and main cooling-water lines including at least one inlet and at least one outlet, said condenser disposed lateral to said turbogroup, and said condenser, said at least one inlet and said at least one outlet disposed in said annex.

2. The steam power station according to claim 1, wherein said turbogroup has a turbine center line, said condenser has a center line located below said turbine center line, and said condenser neck has a gradient towards said condenser.

3. The steam power station according to claim 2, wherein said gradient is predetermined.

* * * * *